United States Patent [19]

Cano

[11] Patent Number: 4,719,545

[45] Date of Patent: Jan. 12, 1988

[54] SOURCE LIGHT FOR CAMERAMEN, LIGHTING TECHNICIANS, SET LIGHTING FOR MOTION PICTURES, STAGE AND TELEVISION

[76] Inventor: Victor M. Cano, 424 N. 12th St., Montebello, Calif. 90640

[21] Appl. No.: 874,147

[22] Filed: Jun. 13, 1986

[51] Int. Cl.[4] ..... F21V 1/00

[52] U.S. Cl. ..... 362/240; 362/241; 362/263; 362/294; 362/373; 362/426

[58] Field of Search ..... 362/6, 11, 16, 18, 33, 362/235, 240, 241, 237, 257, 249, 294, 296, 373, 418, 419, 426, 263, 264, 268, 269, 804, 3

[56] References Cited

U.S. PATENT DOCUMENTS

| | | | |
|---|---|---|---|
| 3,112,076 | 11/1963 | Bobrick | 362/294 |
| 3,140,053 | 7/1964 | Lowell | 362/294 X |
| 3,294,962 | 12/1966 | Hilzen | 362/18 X |
| 3,325,635 | 6/1967 | Wagner et al. | 362/6 |
| 3,588,488 | 6/1971 | Lauterbach | 362/294 X |
| 4,259,709 | 3/1981 | Eddings | 362/240 X |
| 4,293,892 | 10/1981 | Plummer | 362/268 X |
| 4,423,471 | 12/1983 | Gordin et al. | 362/294 X |
| 4,598,347 | 7/1986 | Peppers | 362/294 X |

*Primary Examiner*—Margaret A. Focarino
*Attorney, Agent, or Firm*—Edgar W. Averill, Jr.

[57] ABSTRACT

An improved source light for cameramen, lighting technicians, for set lighting for motion pictures, stage, television and the like. The source light has a vented body containing at least three lamps, each lamp having a halogen cycle bulb held in a reflector which emits a directed beam of light. Each of the reflectors has a generally planar face and all the reflectors are mounted so that their generally planar faces lie in a single plane. A lens means is held adjacent that single plane. Preferably, the lens means is a flat lens which also serves to hold the lamps in place.

21 Claims, 8 Drawing Figures

SOURCE LIGHT FOR CAMERAMEN, LIGHTING TECHNICIANS, SET LIGHTING FOR MOTION PICTURES, STAGE AND TELEVISION

BACKGROUND OF THE INVENTION

The field of the invention is lighting and the invention relates more particularly to lighting of the type used for professional photographers, for set lighting for motion pictures, stage, television and the like.

One of the earliest problems encountered in motion picture photography was the need for sufficient light for exposure. Whereas in still photography the exposure could be extended to provide enough light to expose the film, for motion picture work, this exposure was by necessity limited and, thus, most early films had to be taken out of doors in direct sunlight or under a skylight. Artificial lighting was developed and soon the very bright light emitted by an electric arc was used and referred to as a "klieg" light. For most motion picture and television work, a general level of illumination is established throughout the set to approximate daylight conditions. Second, concentrated beams of light are directed onto people or areas that need to be clearly set forth in the picture. With the introduction of color, not only is the intensity of light important, but also the color of the light. Incandescent lights tend to be far more yellow than electric arc light. The color of the light is typically quantified by a temperature expressed in degrees Kelvin. For instance, a common source light, using a 2,000 watt halogen cycle/quartz bulb provides a light of 3,200 degrees Kelvin. Such lamps can be filtered with a jel filter which increases the color from 3,200 degrees Kelvin to 5,600 degrees which is equivalent to outdoor sunlight.

The problem with the use of lamps having a 2,000 watt halogen cycle/quartz bulb is that such lamps generate a great deal of heat which is, of course, proportionate to the 2,000 watts of energy being used. Such lamps often weigh as much as eighty pounds and are large, bulky and fragile. Not only do such lamps generate a large amount of heat surrounding the bulb, but they also radiate a large amount of heat which, in view of the fact that many such lamps are used together to light the action, can become very uncomfortable for the actors. Another substantial problem with the use of the commonly used 2,000 watt lamps is the difficulty in transporting such lamps to a remote sight. As mentioned above, such lamps typically weigh up to eighty pounds and are large and fragile. Because of their substantial weight, the stands which hold them also must be very sturdy, and as a result, are also heavy and bulky.

Yet another disadvantage of the widely used 2,000 watt, 120 volt, 3,200 degree Kelvin quartz globe is that they are relatively inefficient in their use of light. For instance, although the bulb, itself, contains a small reflector, a large amount of the light emitted by the Tungsten filament is not reflected out of the lamp but instead impinges upon the inner surface of the lamp further increasing the heat and decreasing the amount of light projected from the lamp. Another disadvantage of such heat is the difficulty of changing the bulb when one of the bulbs burns out. The heated assembly is too hot to handle and must cool at least in part before a bulb change. Although such bulbs are rated at one hundred fifty hours, when they have to be moved frequently, the life decreases to about fifty hours. Yet another disadvantage is the amperage required by a 2,000 watt bulb.

Typically sixteen amps are required which is above that permitted by most household circuit breakers which are limited to fifteen amps. Therefore, special generators are typically used to provide sufficient amperage in remote locations. Still further, a Fresnel lens must typically be used to focus the light beam from such lamps and still further, light is lost.

A common home movie or video recorder light comprises a halogen cycle bulb in a single reflector typically attached to the movie camera or VCR camera. Lamps attached to cameras are typically not very useful for professional use because they create a light pattern which may be readily seen in the finished picture. They further create a very sharp shadow which would be unacceptable for most professional purposes. Such lamps are, however, used for remote locations and the decreased quality of light can also be seen during the filming of interviews at fires, floods and the like at night. While such lighting is adequate for emergency use such as this, it is unacceptable for professional television, motion pictures, stage or for professional photographers.

It is, thus, apparent that the presently used system has many shortcomings.

SUMMARY OF THE INVENTION

It is an object of the present invention to provide a light-weight, durable source light providing equivalent light with far less wattage and amperage and providing far cooler light to increase the comfort of the actors.

The present invention is for an improved source light for professional photographers, for set lighting for motion pictures, stage, television and the like of the type having a vented body including a face, sides and a back, said source light including means for attachment to a stand or to a rack or other mount and including means for making electrical connection thereto. The improvement comprises a plurality of lamps held within said vented body, each lamp having a halogen cycle bulb held in a reflector, said reflector being of the type emitting a directed beam and said reflector having a generally planar face. Each of the lamps is mounted so that their beams are directed toward the front of the vented body and the generally planar face of each lamp lies in a single plane. Lens means are held at the face of the vented body and the lens means are adjacent the single plane. Preferably, there are at least three lamps which tend to provide a source light with no discernible light pattern since the plurality of lights tend to cancel any pattern that any one lamp would emit. Preferably, the vented body is made from a metal having a plurality of holes therethrough and providing an opening of about fifty percent. A particularly useful source light is made from four lamps of thirty-volt capacity so that such lamp might be connected into normal household current and voltage. Also, a nine-lamp unit comprising nine twelve-volt lamps also provides a light source of especially long life.

DESCRIPTION OF THE PREFERRED EMBODIMENTS

Figure 1:
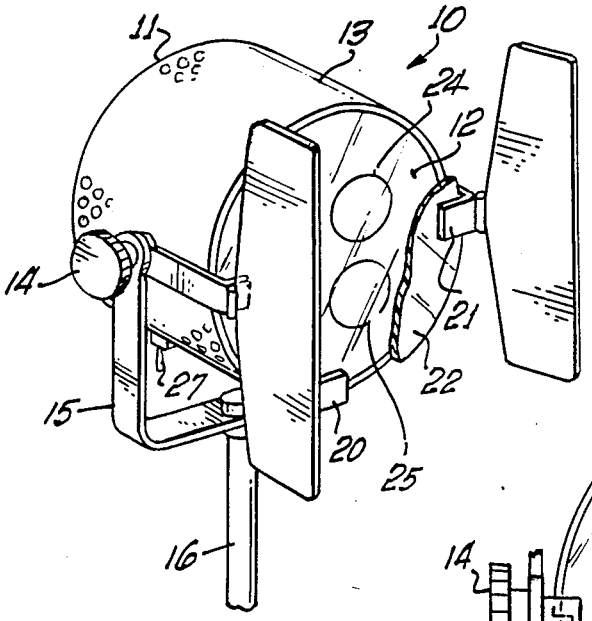
FIG. 1 is a perspective view of the source light of the present invention having four lamps within it.

The source light of the present invention is shown in perspective view in FIG. 1 and indicated by reference character 10. Source light 10 has a back 11, a face 12 and a generally cylindrical sidewall 13. The construction of the sidewall 13 and back 11 of the source light of the present invention provides an important feature of the present invention and is described in detail below. Source light 10 has means for attachment to a stand comprising a threaded opening into which a threaded shaft held to knob 14 is secured. Knob 14 holds a bracket 15 which, in turn, is held to a stand 16 in a conventional manner. A pair of conventional "barn doors" 17 and 18 are held to the source lamp in a conventional manner. Brackets 19 through 21 are conventional and permit the placement of one or more filters indicated by reference character 22. Face 12 comprises a cover lens which serves an important function in the source light of the present invention. Boro-silicate glass is the preferred material and the boro-silicate lens, which comprises face 12, is actually used to hold the individual lamps 23 through 26 in place. This cover lens, or face 12, has another function, namely, that of protection. If one of the lamps should shatter, the lens prevents the glass from falling and causing injury. Boro silicate cover lens 12 protects the individual lamps when the source light is being transported or is simply turned off. Finally, source light 10 is turned on and off by a toggle switch 27.

Figure 2:
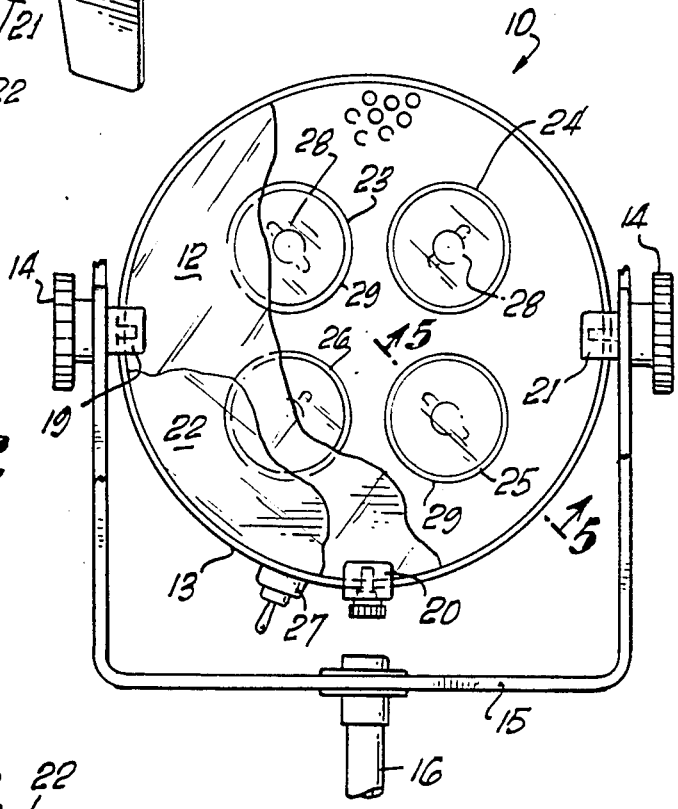
FIG. 2 is an enlarged front view of the lamp of FIG. 1.
Figure 3:
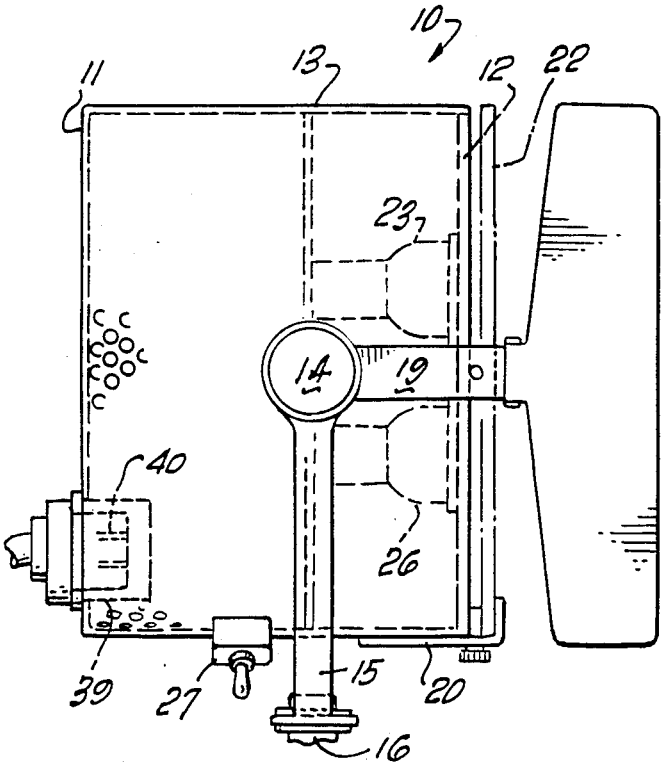
FIG. 3 is an enlarged side view of the lamp of FIG. 1.
Figure 4:
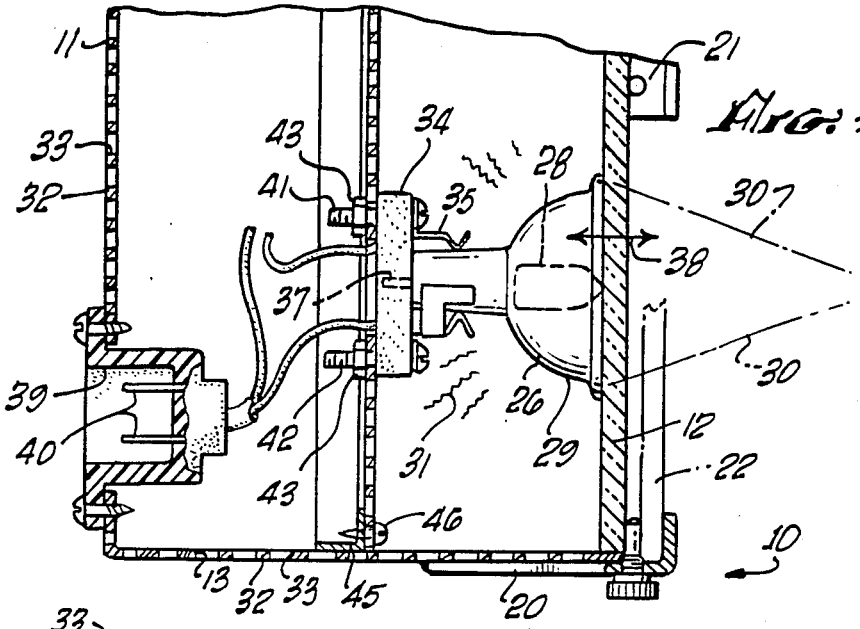
FIG. 4 is an enlarged cross-sectional view of the lower portion of the lamp of FIG. 1.
Figure 5:
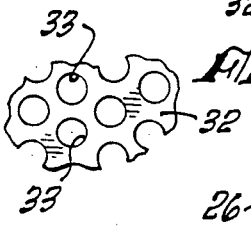
FIG. 5 is an enlarged view of a portion of the foraminous metal body of the lamp of FIG. 1.

Turning now to FIG. 2, it can be seen that lamps 23 through 26 are held on a foraminous plate which is of the same material as that used for sidewall 13 and also for back 11. Although the amount of heat generated by the source light 10 is far less than the commonly used product which it replaces, it, nonetheless, generates a substantial amount of heat which must be carried away efficiently. It has been found that by using a metal with excellent heat-conductivity characteristics and providing a large amount of open space, that the natural convection is sufficient to carry away all the heat generated and permits the lamps to operate at a temperature for which they are designed. For example, the preferred rating for each of the four lamps of source light 10 is thirty volts, two hundred watts and when connected in series draws only six amps and eight hundred watts which is less than half the amount of wattage of the commonly used product. The lamp provides an identical 3,200 degree Kelvin color as does the presently used lamp together with 800 foot candles of light at ten feet as compared to 700 foot candles from the 2,000 watt quartz lamp. The reason for the vastly greater efficiency is the far more efficient use of the light. As shown in FIG. 4 of the drawings, each bulb, such as bulb 28, is held in a reflector 29 which accurately directs a beam of light indicated by reference character 30 and a minimum of light is wasted within the body of the lamp. Another substantial advantage of the source light of the present invention is its use of dichroic reflectors which permit the heat indicated by reference character 31 to pass through the reflector rather than being focused as would be by a standard mirror. It does, however, increase the importance of heat removal from within the body of the source light. For that reason, the aluminum material used is important since it enhances the conduction of heat and reduces the areas of very high temperature. Since the heat is conducted over a wide area, there is a large area for heat transfer. A section of the foraminous material is shown in FIG. 5 and indicated by reference character 32. It can be seen that a plurality of holes 33 are closely spaced and actually provide an open space of approximately fifty percent. A preferred product has been found which is particularly good at increasing heat transfer, namely, a No. 3003-414 aluminum alloy of 0.063 thickness and having three-sixteenths-inch diameter openings on one-fourth-inch staggered centers. To further improve the ruggedness of the light source, the aluminum is powder coated to provide an attractive appearance as well as an essentially scratch-free surface. Such coating is capable of withstanding temperatures to six hundred degrees.

Another important feature of the present invention is the use of an insulated base indicated by reference character 34 in FIG. 4. This base contains a socket and a pair of metal clamps 35 and 36. Each lamp, such as lamp 26, has a pair of contact pins 37 and the lamp is plugged and unplugged by moving it axially in the direction indicated by arrow 38. Thus, once the cover lens 12 is removed, any lamp can easily be pulled out of its insulative base 34 and replaced.

A further advantageous feature of the source light of the present invention is its use of an indented, or machine type plug 39, which helps protect prongs 40 from damage. Thus, a plurality of source lights 10 can be simply stacked or placed together with a minimum of potential damage.

It can also be seen in FIG. 4 that insulative base 34 is held to foraminous plate 32 by a pair of screws 41 and 42 and a pair of nuts 43 and 44. Plate 32 is held securely within sidewall 13 by a circular bracket 45 and a plurality of machine screws 46.

Figure 7:
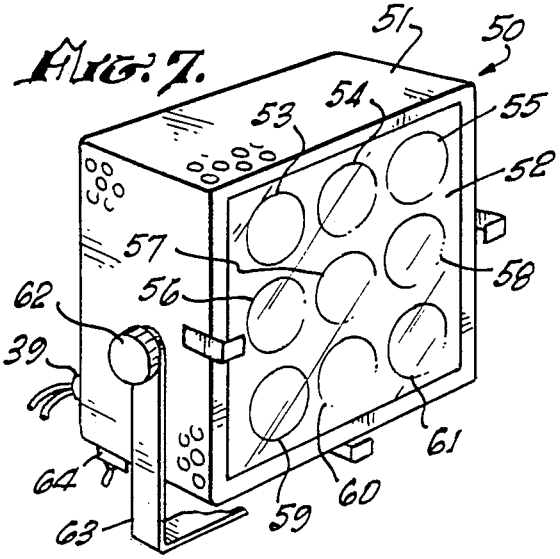
FIG. 7 is a perspective view of an alternate embodiment of the lamp of the present invention.

The lamps 23 through 26 are connected in series and the wire is indicated by reference character 47. Although the present invention has been described in detail utilizing a four-lamp source light, it is not necessary that four lamps be used. It is important that at least three lamps be used to provide a diffused light pattern with no noticeable shadow. However, more than three lamps can readily be used and a nine-lamp source light 50 is shown in perspective view in FIG. 7. Source light 50 has a rectangular body 51 which is preferably made from the same material described above and shown in FIG. 5. A square lens (preferably made from boro-silicate glass) holds the nine lamps in place and is indicated by reference character 52. Lamps 53 through 61 are held in sockets similar to insulative base 34 by square lens 52. Of course, other holding means could be provided. It is necessary, however, that a protective lens cover the individual lamps and it can thus serve a dual purpose of protection and function to hold the lamps in place and obviate the need for such other holding means. A pair of knobs 62, a bracket 63 and a switch 64 are similar to that described above and conventional.

Figure 6:
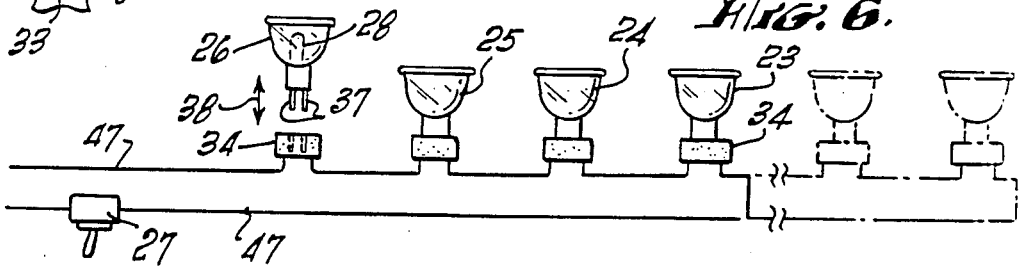
FIG. 6 is a diagrammatic view showing the electrical connection of the lamps, in series, of the lamp of FIG. 1 and also indicating in phantom view the connection of the lamps of the source light of FIG. 7.

Lamps 53 through 61 are preferably seventy-five watt lamps connected in series. Such connection provides an excellent fill light and provides a life of 1,000 hours. The connection of lamps 53 through 61 is indicated in FIG. 6 by phantom lines and two of such lamps are indicated by reference characters 60 and 61.

Figure 8:
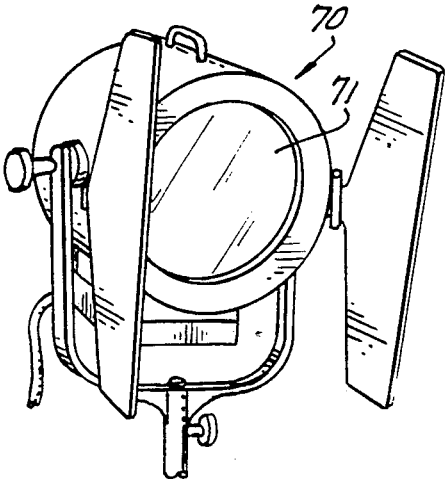
FIG. 8. PRIOR ART
FIG. 8 is a perspective view of the commonly used lamp which may be replaced with the lamp of the present invention.

The commonly used product so widely used today is indicated in FIG. 8 by reference character 70. As stated above, such lamps are very heavy and typically weigh at least thirty-two pounds. They also provide an incredible source of heat and use a large amperage. In contrast, both the lamp indicated as source light 10 in FIG. 1 and that indicated as source light 50 in FIG. 7 weigh only about two pounds. Furthermore, as stated above, the amount of heat generated is far less than commonly used lamp 70. Yet another decrease in weight is provided by the fact that no Fresnel lens such as lens 71 is needed in the lamp of the present invention as was needed in the commonly used lamp. The typical bulb used in commonly used lamp 70 has a small metal reflector within the body of the bulb, but the focusing of the light is provided by a Fresnel lens which directs the light and prevents any discernible light pattern. The source lights of the present invention do not require such lens since the use of at least three lamps provides for an interfering pattern which eliminates most differential light patterns.

As is clear from above, the source light of the present invention provides substantial advantages over the commonly used lamps. They make a far more efficient use of the light and also emit far less heat in the direction of the actors.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. An improved source light for professional photographers, for set lighting for motion pictures, stage, television and the like of the type having a vented body including a face, sides and a back, said source light including means for attachment to a stand or to a rack or other mount, and including means for making electrical connection thereto, wherein the improvement comprises:

a plurality of lamps held within said vented body, each lamp having a halogen cycle bulb held in a dichroic reflector, said dichroic reflector being of the type emitting a directed beam and said dichroic reflector having a generally planar face, each of said lamps being mounted so that their beams are directed toward the front of the vented body and the generally planar face of each lamp lies in a single plane; and lens means held at the face of said vented body, said lens means being adjacent said single plane.

2. The source light of claim 1 wherein there are at least three lamps.

3. The source light of claim 1 wherein the vented body is made from a foraminous metal material having about fifty percent openings.

4. The source light of claim 3 wherein said foraminous metal is aluminum.

5. The source light of claim 4 wherein said foraminous material has a plurality of equally spaced circular openings.

6. The source light of claim 5 wherein each such opening has an inside diameter of about three-sixteenths of an inch on one-fourth-inch staggered centers.

7. The source light of claim 6 wherein said foraminous metal is powder coated.

8. The source light of claim 2 wherein there are four lamps.

9. The source light of claim 2 wherein there are nine lamps.

10. The source light of claim 1 wherein said lamps are mounted on a foraminous metal material held by the interior surface of the sides of said vented body.

11. The source light of claim 10 wherein each lamp is mounted on an insulative base positioned between said lamp and said foraminous metal material.

12. The source light of claim 1 wherein each lamp has a dichroic reflector.

13. The source light of claim 1 wherein said lens is a flat boro-silicate lens.

14. The source light of claim 1 wherein each of said reflectors is multifaceted.

15. The source light of claim 8 wherein each lamp is a thirty-volt lamp connected in series thereby being directly powered by household voltage.

16. The source light of claim 9 wherein each lamp is a twelve-volt lamp connected in series thereby being directly powered by household voltage.

17. An improved source light for professional photographers, for set lighting for motion pictures, stage, television and the like of the type having a vented body including a face, sides and a back, said source light including means for attachment to a stand or to a rack or other mount and including means for making electrical connection thereto, wherein the lamp is easily serviceable, and the improvement comprises:

at least three lamps held within said vented body, each lamp having a halogen cycle bulb held in a multifaceted dichroic reflector, said reflector being of the type emitting a directed beam and said reflector having a generally planar face, each of said lamps being mounted by being plugged in an axial direction into a socket held in an insulative block held to a plate within said vented body, each of said lamps being directed so that its beam is aimed toward the front of the vented body and the generally planar face of each lamp lies in a single plane; and lens means removably held at the face of said vented body, said lens means being adjacent said single plane whereby any lamp may be simply replaced by removing the lens means and pulling the lamp out of its socket and plugging in a new lamp.

18. The source light of claim 17 wherein the electrical connection to said source light is made by a machine plug mounted in said vented body.

19. The source light of claim 18 wherein said machine plug is mounted in the back of said vented body.

20. An improved source light for professional photographers, for set lighting for motion pictures, stage television and the like of the type having a vented body including a face, sides and a back, said source light including means for attachment to a stand, or to a rack, or other mount and including means for making electrical connection thereto, wherein the improvement comprises:

four thirty-volt lamps held within said vented body, each lamp having a halogen cycle bulb held in a reflector, said reflector being of the type emitting a directed beam, and said reflector having a generally planar face, each of said lamps being mounted so that its beam is directed toward the front of the vented body, and the generally planar face of each lamp lies in a single plane and wherein said vented body is cylindrical in shape and fabricated from an aluminum metal sheet having a plurality of openings therethrough; and lens means held at the face of said vented body, said lens means being adjacent said single plane.

21. An improved source light for professional photographers for set lighting for motion pictures, stage, television and the like of the type having a vented body including a face, sides and a back, said source light including means for attachment to a stand, or to a rack, or other mount and including means for making electrical connection thereto, wherein the improvement comprises:

nine twelve-volt lamps held within said vented body, each lamp having a halogen cycle bulb held in a reflector, said reflector being of the type emitting a directed beam and said reflector having a generally planar face, each of said lamps being mounted so that its beam is directed toward the front of the vented body and the generally planar face of each lamp lies in a single plane and wherein said vented body is rectangular in shape and fabricated from an aluminum metal sheet having a plurality of openings therethrough; and lens means held at the face of said vented body, said lens means being adjacent said single plane.

* * * * *